US007641492B2

(12) United States Patent
Azuma et al.

(10) Patent No.: US 7,641,492 B2
(45) Date of Patent: Jan. 5, 2010

(54) ELECTRICAL CONNECTOR HAVING VIBRATION-RESISTING STRUCTURE

(75) Inventors: Keiko Azuma, Makinohara (JP); Chieko Torii, Makinohara (JP); Tomomi Katsuura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/987,736

(22) Filed: Dec. 4, 2007

(65) Prior Publication Data

US 2008/0139039 A1 Jun. 12, 2008

(30) Foreign Application Priority Data

Dec. 7, 2006 (JP) ..... 2006-330428

(51) Int. Cl.
*H01R 13/52* (2006.01)

(52) U.S. Cl. ..... 439/271; 439/272; 439/382

(58) Field of Classification Search ..... 439/271, 439/275, 382, 383, 385
See application file for complete search history.

(56) References Cited

U.S. PATENT DOCUMENTS 4,713,021 A * 12/1987 Kobler ..... 439/272
5,252,088 A * 10/1993 Morello et al. ..... 439/271
2007/0059970 A1* 3/2007 Ichio et al. ..... 439/382

FOREIGN PATENT DOCUMENTS

JP 2005-174813 6/2005

* cited by examiner

*Primary Examiner*—Michael C Zarroli
(74) *Attorney, Agent, or Firm*—Edwards Angell Palmer & Dodge LLP

(57) ABSTRACT

A connector including: a first connector housing having a tube-shaped hood part; a second connector housing to be fitted to the first connector housing; and a groove part provided on the second connector housing, wherein a terminal receiving part of the second connector housing is positioned in the hood part so that the first and second connector housings are fitted to each other, wherein an end part of the hood part enters the groove part when the first and second connector housings are fitted to each other.

3 Claims, 9 Drawing Sheets

ELECTRICAL CONNECTOR HAVING VIBRATION-RESISTING STRUCTURE

BACKGROUND OF THE INVENTION (1) Field of the Invention

The present invention relates to a connector having a vibration-resisting structure.

(2) Description of the Related Art

A motor vehicle mounts various electronic instruments which are connected to the motor vehicle and other electronic instruments through a wiring harness. The electronic instruments are connected to the wiring harness when connectors of the electronic instruments are coupled with those of the wiring harness.

The connector includes a connector housing and a terminal fitting to be received in the connector housing. When the connectors are coupled with each other, the respective terminal fittings in the connector housing are electrically connected to each other. Then, the wiring harness transmits electric power, control signals and so on to the electronic instruments.

Such a connector may be often used under a severe condition of vibration such as a condition in an engine room. In such a case, the connector is shaken due to the vibration causing the connector to suffer from failure in electrical continuity due to abrasion of an electrical contact of the terminal fitting.

In order to solve the above problem, various connectors have been proposed (for example, see Japanese Patent Application Laid-Open No. 2005-174813). Such a connector includes a male connector housing (hereinafter, male housing) and a female connector housing (hereinafter, female housing) which fits to the male housing. The male housing includes: a body part receiving terminal fittings; a resilient member attached to the outside of the body part; and an outer housing formed outside the body part being spaced from the body part. The male housing includes the hood-shaped body part which receives the terminal fittings.

After the body part of the female housing enters between the body part of the male housing and the outer housing, then the male and female housings fit to each other. The resilient member is positioned between the outside of the body part of the male housing and the inside of the body part of the female housing. Then, an end part of the female housing presses one end part of the resilient member near the male housing, while a projection formed on an inner surface at the base end part-side of the body part of the female housing presses an opposite end part of the resilient member.

In the connector described in Japanese Patent Application Laid-Open No. 2005-174813, the resilient member is positioned between the outside of the body part of the male housing and the inside of the body part of the female housing. Therefore, the outer housing of the male housing may be shaken due to vibration, causing the connector to suffer from failure in electrical continuity due to abrasion of an electrical contact of the terminal fitting. When things come to the worst, the terminal fitting may be damaged.

SUMMARY OF THE INVENTION

It is therefore an objective of the present invention to solve the above problem and to provide a connector, by which the connector can be prevented from being shaken with a simple structure thereof so that the terminal fitting can be prevented from suffering from failure in electrical continuity.

In order to attain the above objective, the present invention is to provide a connector including:

a first connector housing having a tube-shaped hood part;

a second connector housing to be fitted to the first connector housing; and a groove part provided on the second connector housing, wherein a terminal receiving part of the second connector housing is positioned in the hood part so that the first and second connector housings are fitted to each other, wherein an end part of the hood part enters the groove part when the first and second connector housings are fitted to each other.

With the construction described above, the second connector housing includes the groove part into which the end part of the hood part of the first connector housing enters. Therefore, the end part of the hood part enters the groove part so that the first and second connector housings are fixed to each other stably. Accordingly, the connector can be prevented from being shaken with a simple structure thereof so that the connector can be prevented from suffering from failure in electrical continuity due to abrasion of the terminal fitting.

A width of the groove part decreases from a hood part-entering side of the groove part to the depth side of the groove part.

With the construction described above, the end part of the hood part comes in stable contact with the inner surface of the groove part, so that the first and second connector housings are further stably fixed to each other. Accordingly, the connector can be further prevented from being shaken with a simple structure thereof so that the connector can be prevented from suffering from failure in electrical continuity due to abrasion of the terminal fitting.

At least one of an inner surface of the groove part and the end part of the hood part includes a resilient member made of resilient material.

With the construction described above, the inner surface of the groove part closely comes in contact with the end part of the hood part through the resilient member, so that the resilient member is resiliently deformed so as to absorb the shaking of the connector. Accordingly, the connector can be further prevented from being shaken with a simple structure thereof so that the connector can be prevented from suffering from failure in electrical continuity due to abrasion of the terminal fitting. Moreover, by composing the resilient member with heat resisting resilient material, the effect for preventing the shaking of the connector can be prevented from reducing due to heat deterioration.

The first connector housing includes an engaging part, the second connector housing includes a mating engaging part to be engaged with the engaging part, and at least one of the engaging part and the mating engaging part includes a resilient member made of resilient material.

With the construction described above, the engaging part closely comes in contact with the mating engaging part through the resilient member and the resilient member is resiliently deformed so as to absorb the shaking of the connector. Accordingly, the connector can be further prevented from being shaken with a simple structure thereof so that the connector can be prevented from suffering from failure in electrical continuity due to abrasion of the terminal fitting. Moreover, by composing the resilient member with heat resisting resilient material, the effect for preventing the shaking of the connector can be prevented from reducing due to heat deterioration.

DESCRIPTION OF THE PREFERRED EMBODIMENTS

Figure 1:
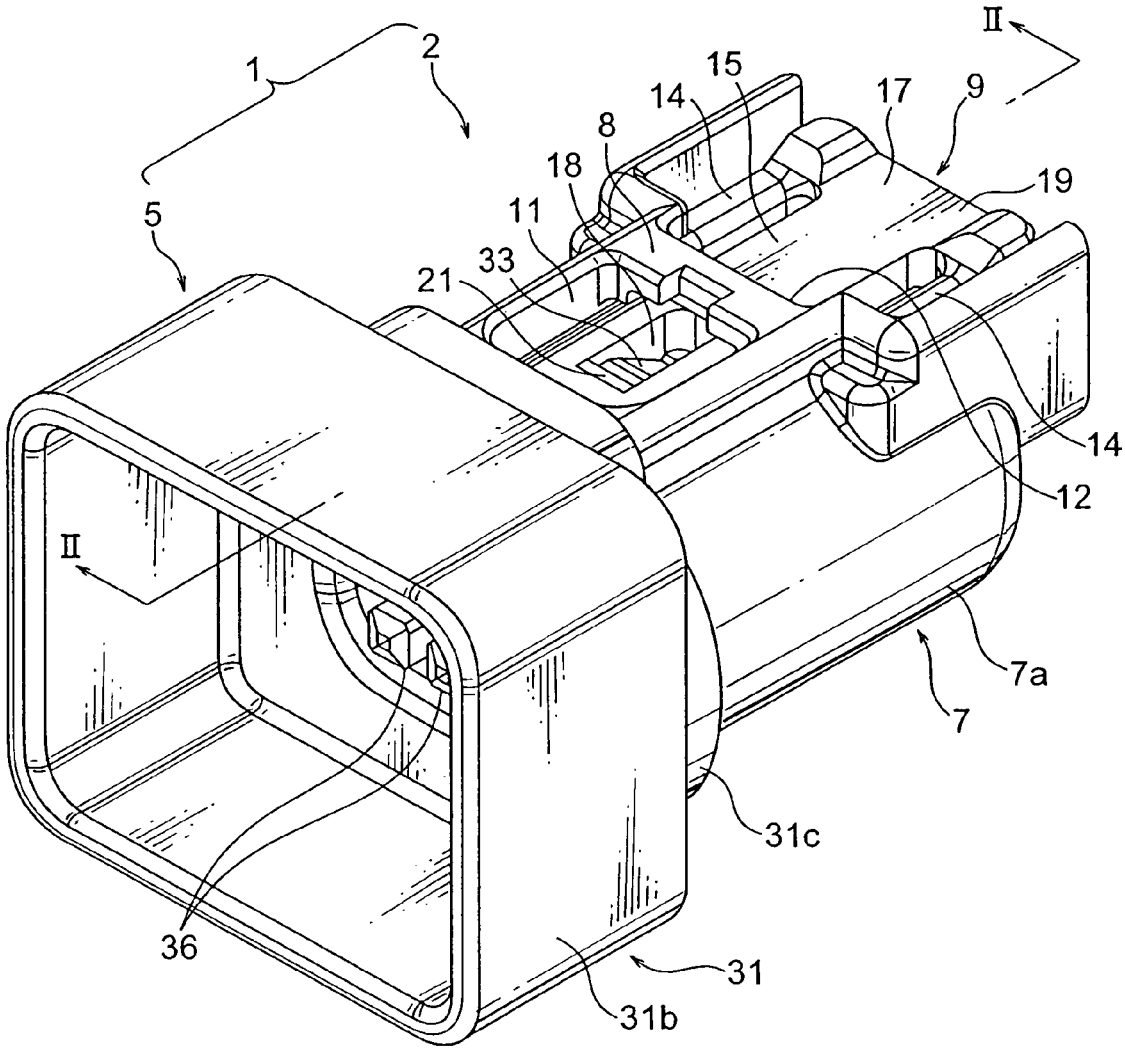
FIG. 1 is a perspective view illustrating a connector according to the first preferred embodiment of the present invention.
Figure 2:
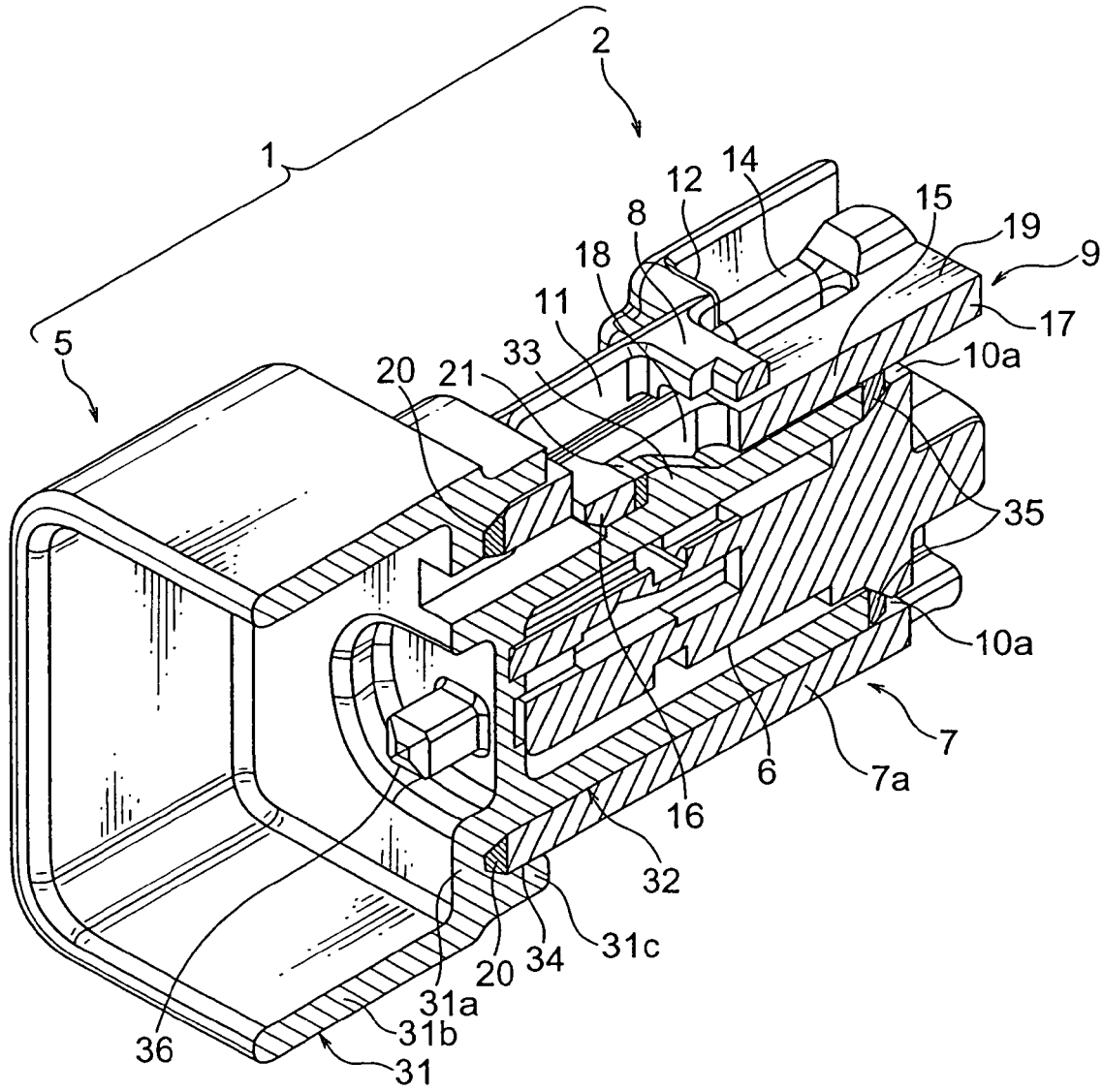
FIG. 2 is a cross sectional view taken along II-II line in FIG. 1.

In the following, a connector according to the first preferred embodiment of the present invention will be explained with reference to FIGS. 1-8. As shown in FIGS. 1 and 2, a connector 1 according to the first preferred embodiment of the present invention includes a male connector housing 2 (hereinafter, male housing 2) and a female connector housing 5 (hereinafter, female housing 5).

In the first preferred embodiment, the male housing 2 corresponds to the first connector housing described in the claims and the female housing 5 corresponds to the second connector housing described in the claims. An outer housing 7 (explained later) of the male housing 2 corresponds to the hood part described in the claims, a body part 32 (explained later) of the female housing 5 corresponds to the terminal receiving part described in the claims, and a groove 34 (explained later) of the female housing 5 corresponds to the groove part described in the claims.

Figure 6:
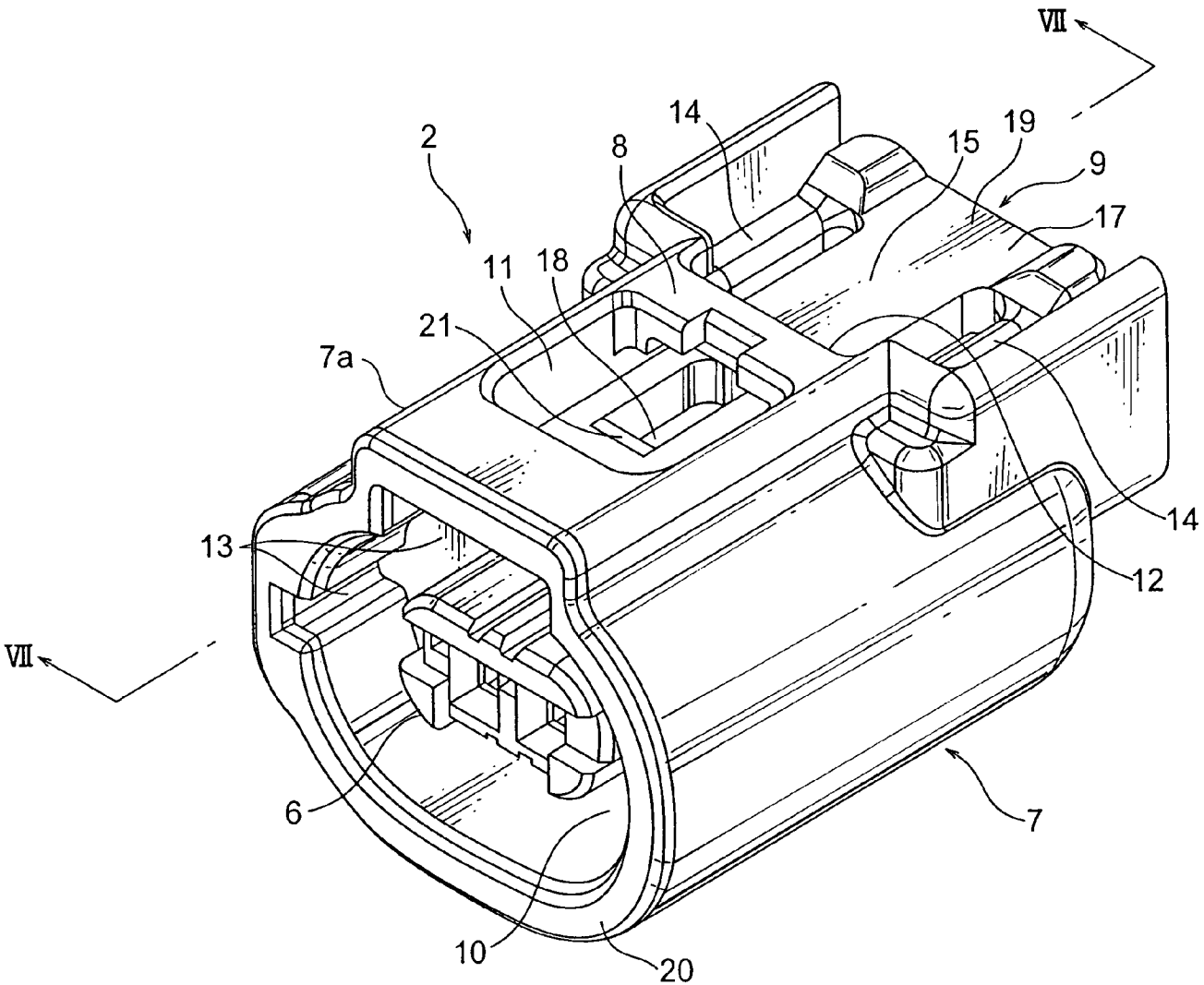
FIG. 6 is a perspective view of a male housing shown in FIG. 1.
Figure 7:
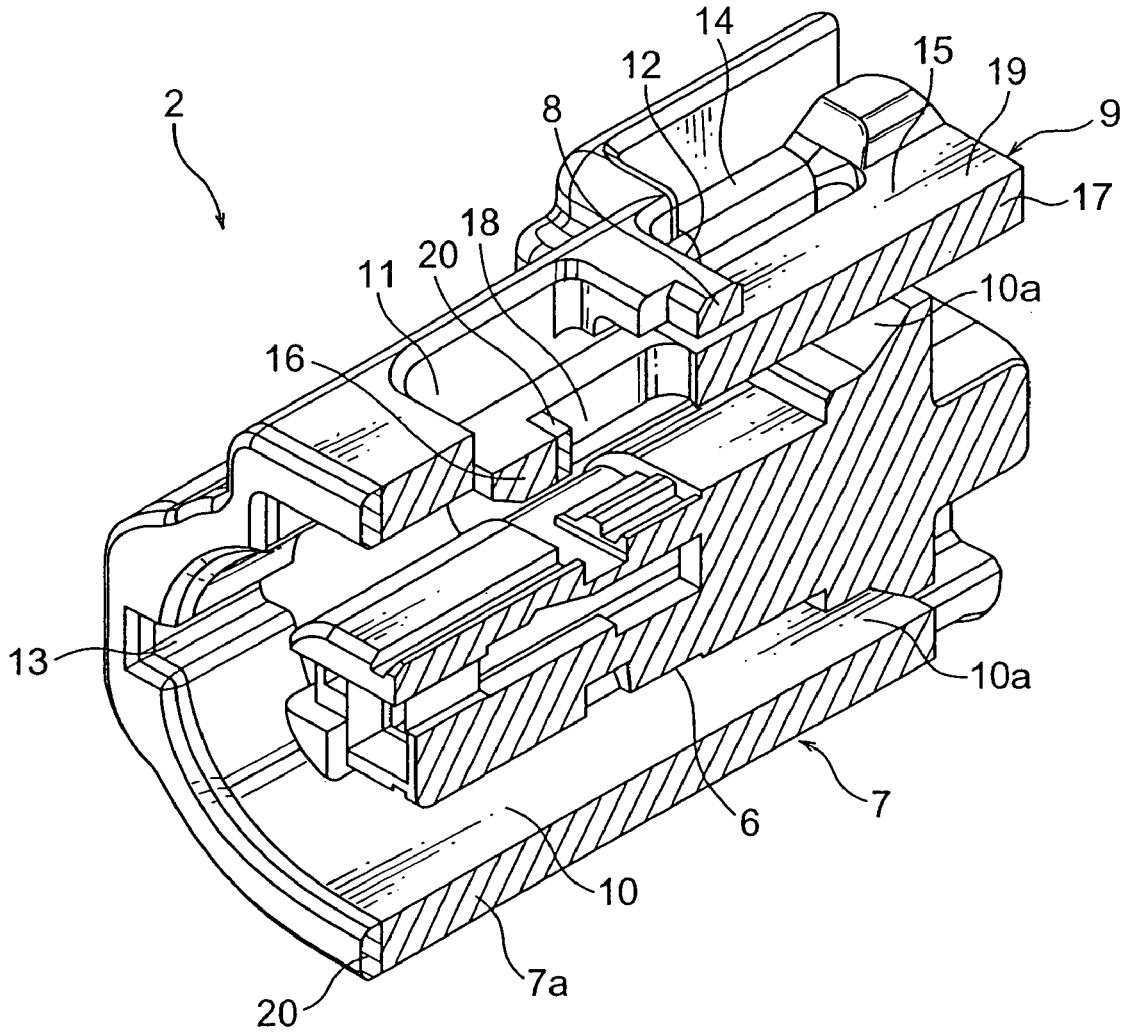
FIG. 7 is a cross sectional view taken along VII-VII line in FIG. 6.
Figure 8:
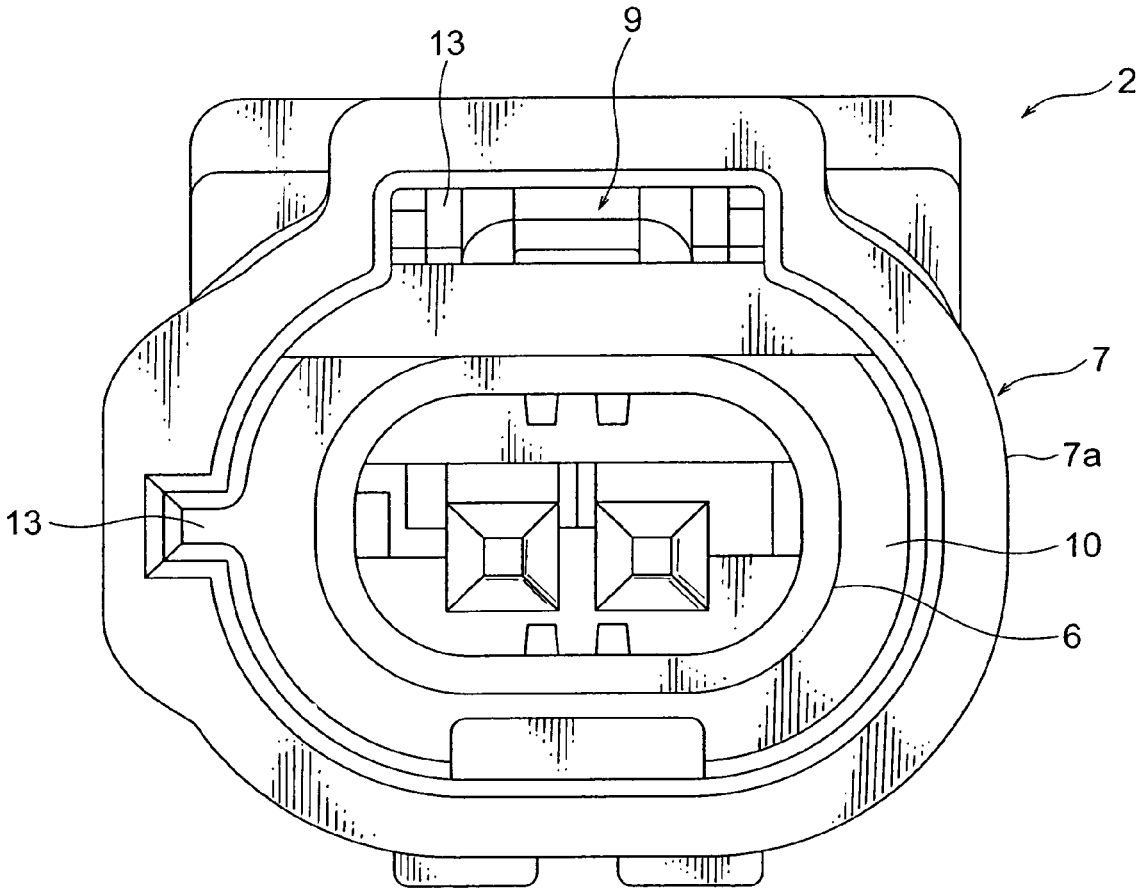
FIG. 8 is a front view of a male housing shown in FIG. 6.

The male housing 2 is made of electrically insulating synthetic resin or the like. As shown in FIGS. 6 and 7, the male housing 2 includes a body part 6 and an outer housing 7. The body part 6 is formed in a tube-shape. The body part 6 receives a terminal fitting (not shown in the figure) attached to an end of an electric wire therein. The terminal fitting is made of electrically conductive sheet metal or the like. This terminal fitting is electrically connected to a terminal fitting of the female housing 5 when the male housing 2 and the female housing 5 are fitted to each other.

The outer housing 7 is formed in a tube-shape including an outer wall 7*a*. The outer housing 7 receives the body part 6 therein. The outer housing 7 is arranged spaced from the body part 6. As shown in FIG. 7, the outer housing 7 includes a hole 11, notched part 12, guide recess 13, resilient member 20, contact part 8, and locking arm 9.

The hole 11 is formed in a rectangular shape in a plan view. The hole 11 is formed penetrating through the outer wall 7*a* of the outer housing 7 near the female housing 5 to be fitted, to which the outer housing 7 fits. The hole 11 is formed penetrating through the outer wall 7*a* of the housing 7, the outer wall 7*a* facing the locking arm 9. The hole 11 exposes one end part 16 (explained later) of the locking arm 9. The hole 11 permits the one end part 16 of the locking arm 9, which is resiliently deformed, to pass therethrough.

The notched part 12 is formed by notching the outer wall 7*a* in a direction approaching the female housing 5 from an end part of the outer housing 7, which end part is situated away from the female housing 5 to be fitted, to which the outer housing 7 fits. The notched part 12 and the hole 11 are arranged lined up along a fitting direction of the male housing 2 and the female housing 5.

As shown in FIG. 6, a plurality of the guide recesses 13 are formed from an inner surface of the outer housing 7. The guide recess 13 extends along the fitting direction of the male housing 2 and the female housing 5. A guide rib 37 (explained later) of the female housing 5 enters the guide recess 13 so as to make the male housing 2 and the female housing 5 be fitted to each other in a proper direction.

The resilient member 20 is provided on an end part (i.e. an end part near the female housing 5 to be fitted) of the outer housing 7. The resilient member 20 is provided by assembling, two-color molding or the like. The resilient member 20 is made of resilient material such as rubber. The resilient member 20 is made of heat resisting resilient material in order to prevent the effect for preventing the shaking of the connector from reducing due to heat deterioration. The resilient member 20 comes in contact with a groove 34 (explained later) of the female housing 5 so as to prevent the end part of the outer housing 7 from being shaken within the groove 34.

As shown in FIG. 6, the contact part 8 is formed in a prism-shape and continues to the outer housing 7 at both ends in the longitudinal direction of the contact part 8. The contact part 8 is arranged in a direction crossing at right angles the longitudinal direction of the locking arm 9. The contact part 8 is arranged between the hole 11 and the notched part 12. The contact part 8 is arranged facing the locking arm 9 and being spaced from the locking arm 9. The contact part 8 comes in contact with the locking arm 9 when the locking arm 9 engages with an engaging projection 33 of the female housing 5.

The locking arm 9 is formed continuing to the outer wall 7*a* of the outer housing 7. The longitudinal direction of the locking arm 9 is parallel to the fitting direction of the male housing 2 and the female housing 5. An end part 16 (situated left in FIG. 7) of the locking arm 9 in the longitudinal direction thereof is arranged near the female housing 5 to be fitted, while an opposite end part 17 (situated right in FIG. 7) of the locking arm 9 in the longitudinal direction thereof is arranged away from the female housing 5. The locking arm 9 includes: a connecting part 14 for connecting to the outer housing 7; and an arm body 15.

A pair of the connecting parts 14 is provided, each extending in a direction leaving the female housing 5 to be fitted from the outer wall 7*a* of the outer housing 7, which is notched to the notched part 12. A contact part between the connecting part 14 and the outer wall 7*a* is positioned at the center of the locking arm 9 in the longitudinal direction thereof. The connecting parts 14 position the arm body 15 therebetween. A pair of the connecting parts 14 is connected to an opposite end part 17 of the arm body 15.

The arm body 15 is formed in a band plate-shape. The arm body 15 is arranged between the body part 6 and an outer housing 7. As shown in FIG. 7, the arm body 15 includes an engaging hole 18 as the engaging part and an operation part 19.

The engaging hole 18 penetrates through the arm body 15. The engaging hole 18 is formed at the end part 16 of the arm body 15. The engaging hole 18 is formed in a rectangular shape in a plan view. An engaging projection 33 (explained later) of the female housing 5 enters the engaging hole 18. When the engaging projection 33 enters the engaging hole 18, the locking arm 9 engages with the engaging projection 33 so as to maintain the fitting between the male housing 2 and the female housing 5. An inner surface of the engaging hole 18 is provided with the resilient member 21.

The resilient member 21 is formed on the inner surface of the engaging hole 18 near the female housing 5 to be fitted. The resilient member 21 is provided by assembling, two-color molding or the like. The resilient member 21 is made of resilient material such as rubber. The resilient member 21 is made of heat resisting resilient material in order to prevent the effect for preventing the shaking of the connector from reducing due to heat deterioration. The resilient member 21 comes in contact with the engaging projection 33 so as to prevent the engaging projection 33 from being shaken within the engaging hole 18.

The operation part 19 is provided on an outer surface of the arm body 15 situated away from the body part 6. The operation part 19 is provided at the opposite end part 17 of the arm body 15. When the operation part 19 is pushed down, the engagement between the locking arm 9 and the engaging projection 33 is removed.

As shown in FIG. 7, a gap 10 is formed between the body part 6 and the outer housing 7. An outer wall 32*a* of the body part 32 enters the gap 10. An end part 10*a* of the gap 10 situated away from the female housing 5 to be fitted is formed in a tapered shape so that the width of the end part 10*a* decreases as approaching the depth side (i.e. right side in FIG. 7). The end part 10*a* may be formed in an arc-shape in section.

Figure 3:
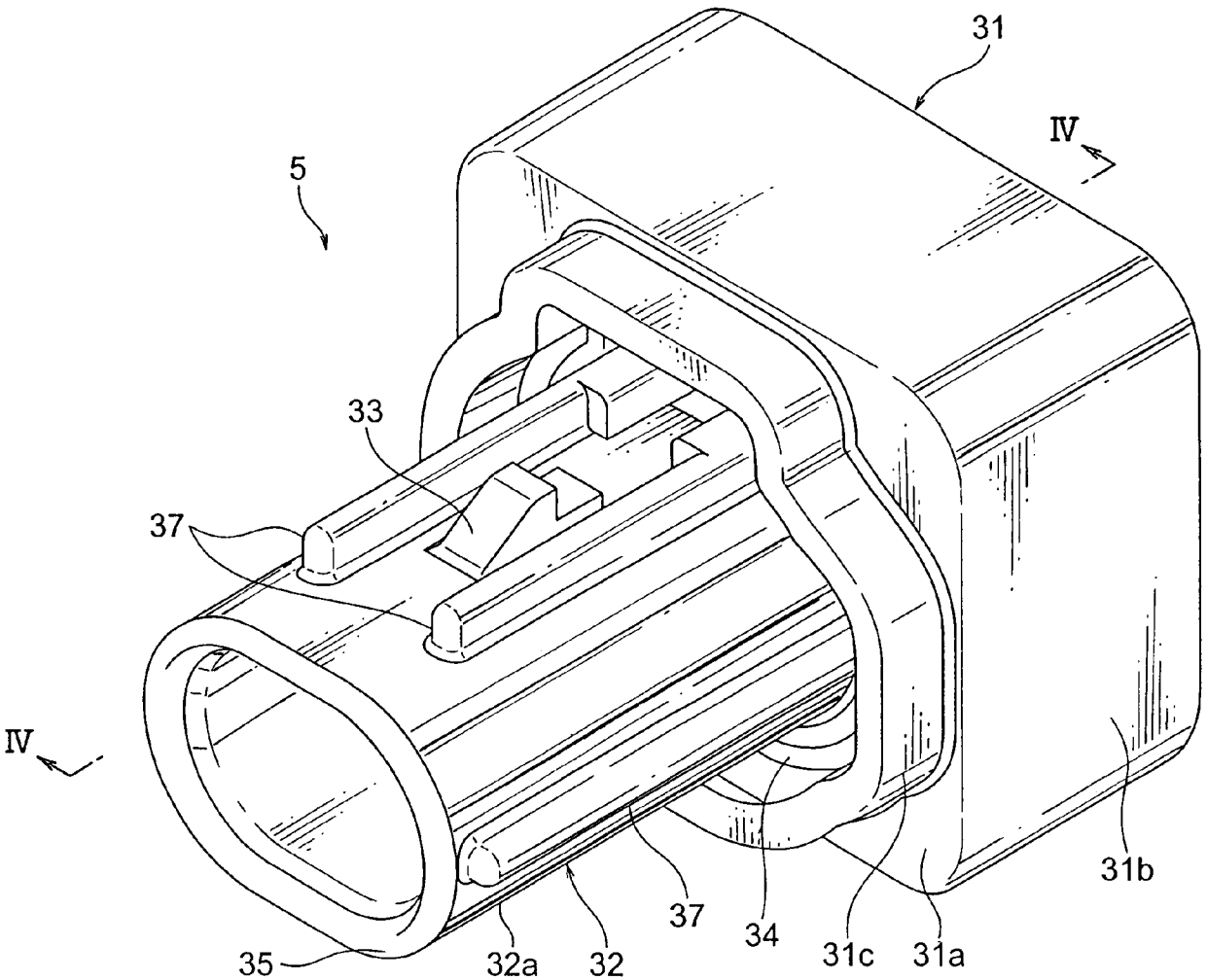
FIG. 3 is a perspective view of a female housing shown in FIG. 1.
Figure 4:
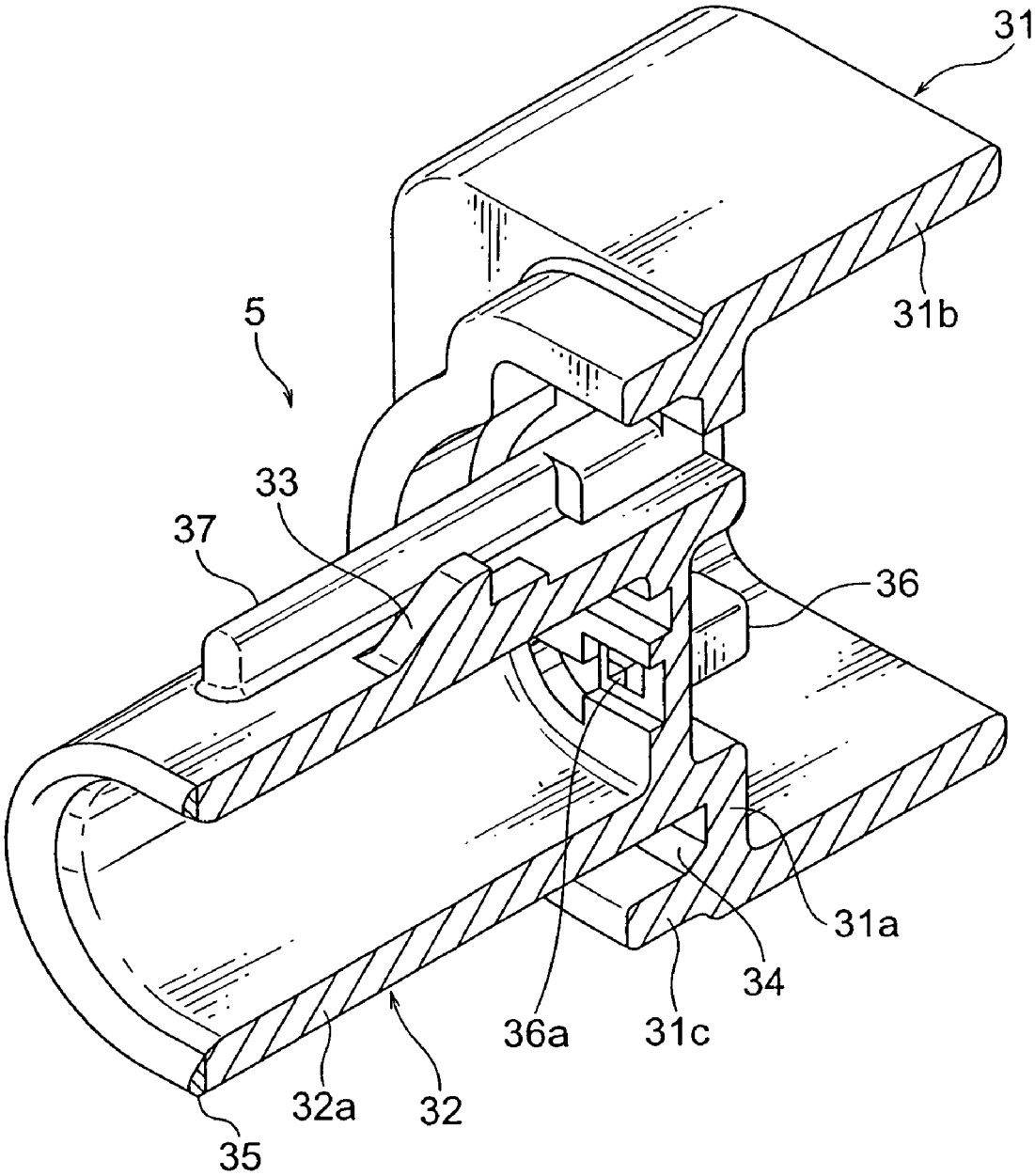
FIG. 4 is a cross sectional view taken along IV-IV line in FIG. 3.
Figure 5:
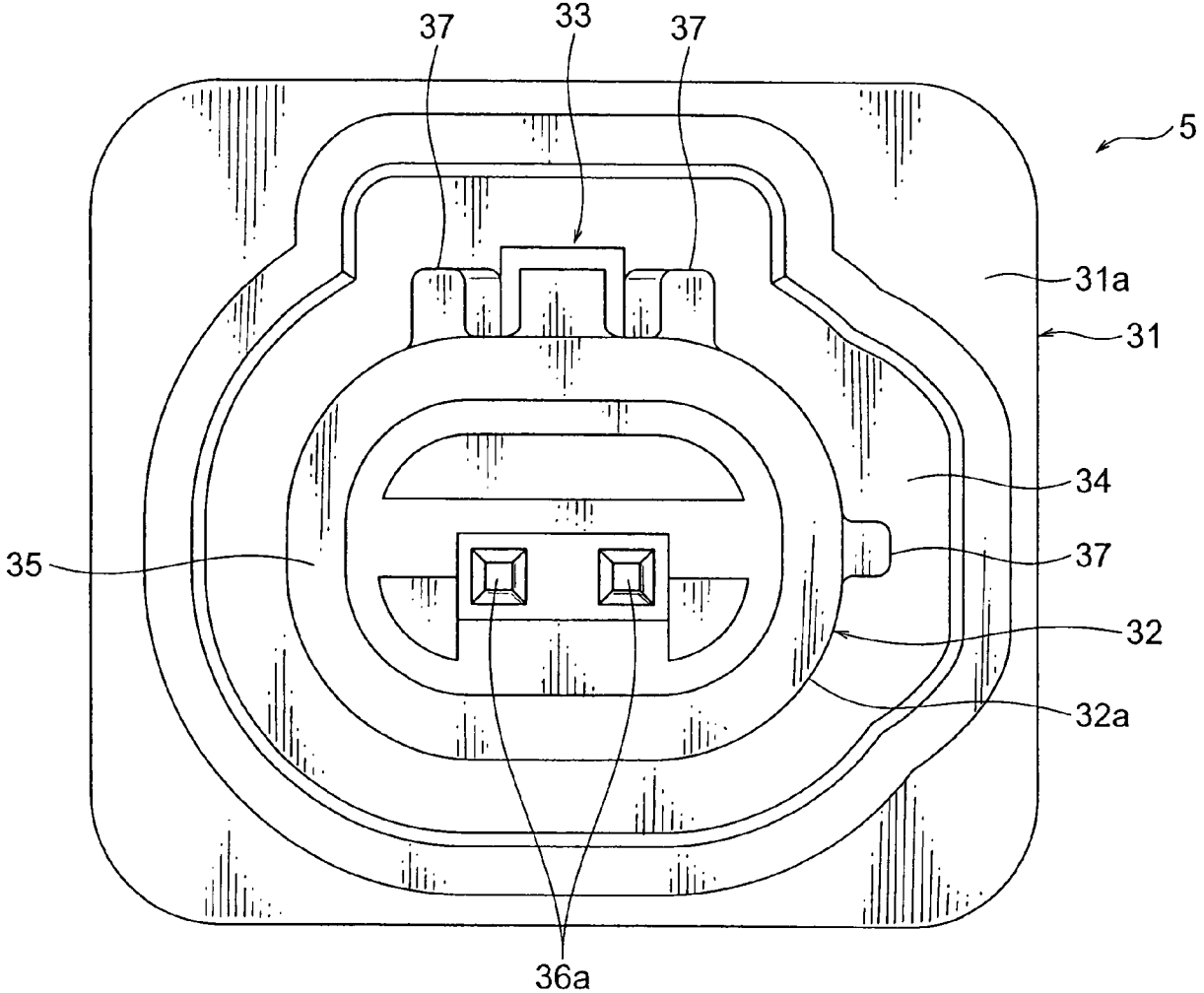
FIG. 5 is a front view of a female housing shown in FIG. 3.

The female housing 5 is made of electrically insulating synthetic resin or the like. As shown in FIGS. 3 and 4, the female housing 5 includes a cover part 31, body part 32, engaging projection 33 as the mating engaging part, and groove 34. The cover part 31 is formed in a tube-shape having a bottom. The cover part 31 is provided on the female housing 5 at the side situated away from the male housing 2 to be fitted. The cover part 31 includes a bottom wall 31*a*, peripheral wall 31*b* continuing to a peripheral edge of the bottom wall 31*a*, and rising-up wall 31*c*.

The bottom wall 31*a* is formed in a flat plate-shape. The bottom wall 31*a* is arranged in a direction crossing at right angles the fitting direction between the female housing 5 and the male housing 2. As shown in FIG. 4, the bottom wall 31*a* includes a terminal hole part 36 through which a terminal fitting (not shown in the figure) passes. The terminal hole part 36 is formed in a tube-shape and formed projecting from an outer surface of the bottom wall 31*a* situated away from the body part 32. The inside of the terminal hole part 36 is provided with a terminal hole 36*a* through which the terminal fitting passes and projects toward the body part 32.

The peripheral wall 31*b* is formed from the peripheral edge of the bottom wall 31*a* extending in a direction leaving the body part 32. The rising-up wall 31*c* is formed rising up from an outer surface of the bottom wall 31*a* near the body part 32. The rising-up wall 31*c* is formed throughout the entire outer periphery of the body part 32 having a distance from the outer wall 32*a* of the body part 32.

The body part 32 is formed in a tube-shape by the outer wall 32*a*. The body part 32 continues to the bottom wall 31*a* of the cover part 31. The inside of the body part 32 receives a terminal fitting (not shown in the figure) entered into the terminal hole 36. The terminal fitting is made of an electrically conductive sheet metal or the like. The terminal fitting is attached to an end of an electric wire. When the female housing 5 and the male housing 2 fit to each other, the terminal fitting is electrically connected to a terminal fitting of the male housing 2. As shown in FIG. 4, the body part 32 includes a guide rib 37 and a resilient member 35.

A plurality of the guide ribs 37 are formed projecting from the outer surface of the body part 32. The guide rib 37 extends along the fitting direction between the female housing 5 and the male housing 2. The guide rib 37 enters the guide recess 13 of the male housing 2 so as to fit the female housing 5 and the male housing 2 to each other in a proper direction.

The resilient member 35 is provided at an end part (i.e. end part near the male housing 2 to be fitted) of the body part 32. The resilient member 35 is provided by assembling, two-color molding or the like. The resilient member 35 is made of resilient material such as rubber. The resilient member 35 is made of heat resisting resilient material in order to prevent the effect for preventing the shaking of the connector from reducing due to heat deterioration. The resilient member 35 comes in contact with an end part 10*a* of a gap 10 (explained later) of the male housing 2 so as to prevent the end part of the body part 32 from being shaken within the end part 10*a*.

As shown in FIG. 3, the engaging projection 33 is formed projecting from the outer surface of the body part 32. The engaging projection 33 engages with the engaging hole 18 of the locking arm 9 of the male housing 2 so as to maintain the engagement between the female housing 5 and the male housing 2.

As shown in FIG. 4, the groove 34 is formed between the rising-up wall 31*c* and the outer wall 32*a* of the body part 32. An end part of the outer housing 7 of the male housing 2 enters the groove 34. The groove 34 is formed in a tapered shape so that the width of the groove 34 decreases as approaching the depth side (i.e. right side in FIG. 4). The groove 34 may be formed in an arc-shape in section.

When the connector 1 having the structure described above is assembled, first, the outer wall 32*a* of the body part 32 of the female housing 5 is allowed to enter the gap 10 between the body part 6 and the outer housing 7 of the male housing 2. Then, the engaging projection 33 of the female housing 5 comes in contact with the end part 16 of the locking arm 9 of the male housing 2. The locking arm 9 is pushed up by the engaging projection 33 so as to be resiliently deformed, so that the locking arm 9 comes in contact with the contact part 8.

When the male housing 2 is allowed to further approach the female housing 5, the engaging projection 33 further pushes up a portion of the locking arm 9 ranging from the end part of the locking arm 9 to the contact part 8. Then, the engaging projection 33 enters the engaging hole 18 of the locking arm 9, so that the engaging hole 18 engages with the engaging projection 33. The engaging projection 33 resiliently deforms the resilient member 21 of the engaging hole 18, so that the engaging projection 33 is received in the engaging hole 18 without being shaken. As a result, the male housing 2 and the female housing 5 fit to each other, thereby assembling the connector 1.

When the male housing 2 and the female housing 5 fit to each other, the outer housing 7 of the male housing 2 positions the body part 32 of the female housing 5 thereinside. Further, the body part 32 of the female housing 5 positions the body part 6 of the male housing 2 thereinside.

As shown in FIG. 2, the end part of the outer housing 7 of the male housing 2 enters the groove 34 of the female housing 5. The resilient member 20 of the end part of the outer housing 7 is resiliently deformed, closely comes in contact with the inner surface of the groove 34 formed in a tapered shape, and is received in the groove 34 without being shaken. Further, the end part of the body part 32 of the female housing 5 enters the end part 10*a* of the gap 10 of the male housing 2. The resilient member 35 of the end part of the body part 32 is resiliently deformed, closely comes in contact with the end part 10*a* of the gap 10 formed in a tapered shape, and is received in the end part 10*a* without being shaken.

According to the preferred embodiment described above, the female housing 5 includes the groove 34, into which the end part of the outer housing 7 of the male housing 2 enters. Therefore, the end part of the outer housing 7 enters the groove 34, so that the female housing 5 and the male housing 2 are stably fixed to each other. Accordingly, the connector 1 can be prevented from being shaken with the simple structure thereof so that the connector can be prevented from suffering from failure in electrical continuity due to abrasion of the terminal fitting.

The width of the groove 34 is formed to decrease as the groove 34 leaves the end part of the outer housing 7. Therefore, the end part of the outer housing 7 stably comes in contact with the inner surface of the groove 34, so that the female housing 5 and the male housing 2 are further stably fixed to each other. Accordingly, the connector 1 can be prevented from being shaken with the simple structure thereof so that the connector can be prevented from suffering from failure in electrical continuity due to abrasion of the terminal fitting.

The end part of the outer housing 7 includes the resilient member 20. Therefore, the end part of the outer housing 7 closely comes in contact with the inner surface of the groove 34 through the resilient member 20, and the resilient member 20 is resiliently deformed so as to absorb the shaking of the male housing 2 and the female housing 5. Accordingly, the connector 1 can be prevented from being shaken with the simple structure thereof so that the connector can be prevented from suffering from failure in electrical continuity due to abrasion of the terminal fitting. Further, by composing the resilient member 20 with heat resisting resilient material, the effect for preventing the shaking of the connector 1 can be prevented from reducing due to heat deterioration.

The male housing 2 includes the engaging hole 18, the female housing 5 includes the engaging projection 33, and the engaging hole 18 includes the resilient member 21. Therefore, the engaging hole 18 closely comes in contact with the engaging projection 33 through the resilient member 21, and the resilient member 21 is resiliently deformed so as to absorb the shaking of the male housing 2 and the female housing 5. Accordingly, the connector 1 can be prevented from being shaken with the simple structure thereof so that the connector 1 can be prevented from suffering from failure in electrical continuity due to abrasion of the terminal fitting. Further, by composing the resilient member 21 with heat resisting resilient material, the effect for preventing the shaking of the connector 1 can be prevented from reducing due to heat deterioration.

In the first preferred embodiment described above, the resilient member 20 is provided on the end part of the outer housing 7. However, instead, the resilient member 20 may be provided on the inner surface of the groove 34. Further, the resilient member 20 may be provided on both the end part of the outer housing 7 and the inner surface of the groove 34.

Further, in the first preferred embodiment described above, the resilient member 21 is provided on the inner surface of the engaging hole 18. However, instead, the resilient member 21 may be provided on the outer surface of the engaging projection 33. Further, the resilient member 21 may be provided on both the inner surface of the engaging hole 18 and the outer surface of the engaging projection 33.

In the following, a connector according to the second preferred embodiment of the present invention will be explained with reference to FIG. 9.

In the second preferred embodiment, the female housing 5 corresponds to the first connector housing described in the claims and the male housing 2 corresponds to the second connector housing described in the claims. An outer wall 32*a* of a body part 32 of the female housing 5 corresponds to the hood part described in the claims, a body part 6 of the male housing 2 corresponds to the terminal receiving part described in the claims, and an end part 10*a* of the male housing 2 corresponds to the groove part described in the claims.

Figure 9:
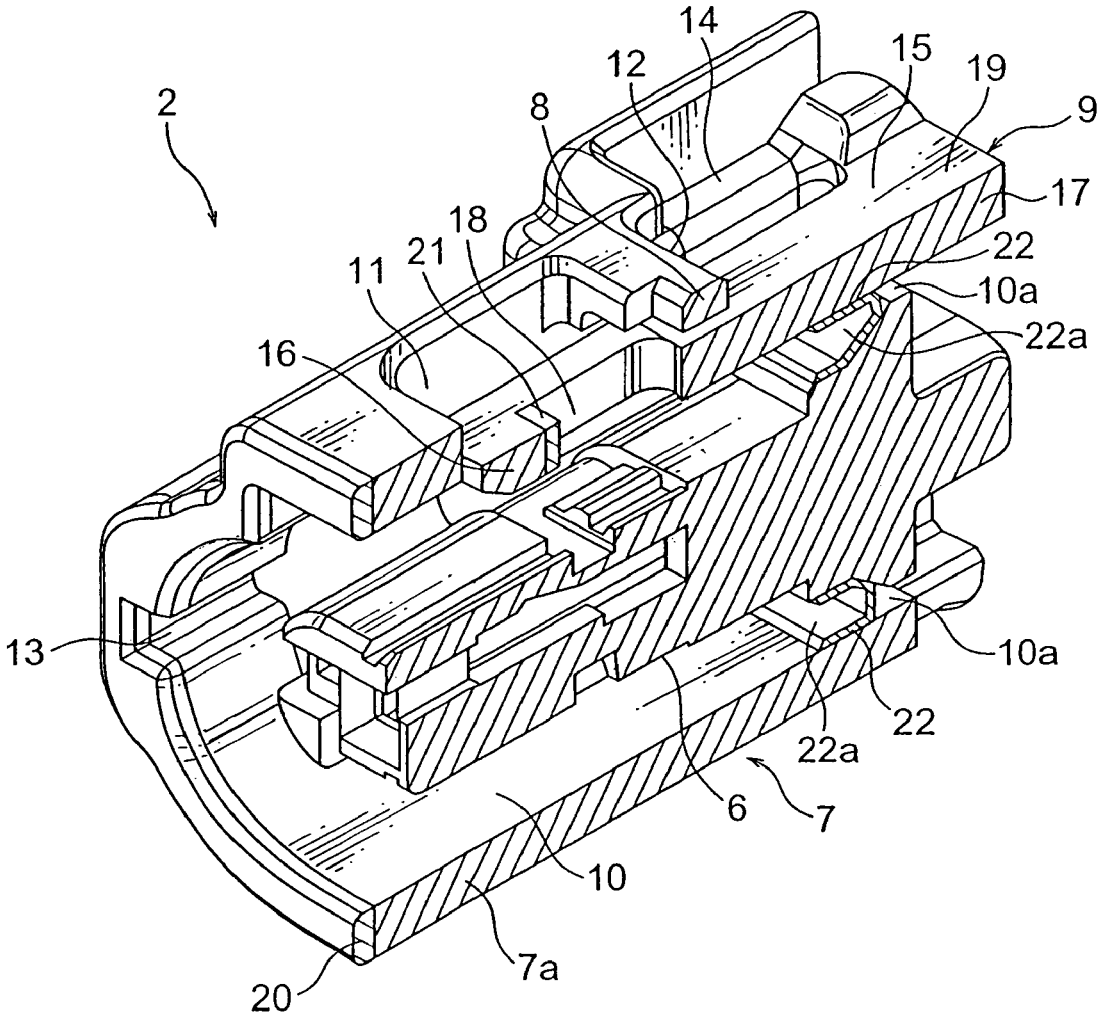
FIG. 9 is a cross sectional view illustrating a male housing of a connector according to the second preferred embodiment of the present invention.

As shown in FIG. 9, the male housing 2 according to the second preferred embodiment includes a resilient member 22 on an end part 10*a* of a gap 10 formed between a body part 6 and an outer housing 7. The resilient member 22 is provided on an inner surface of the end part 10*a* by assembling, two-color molding or the like. The resilient member 22 is made of resilient material such as rubber. The resilient member 22 is made of heat resisting resilient material in order to prevent the effect for preventing the shaking of the connector from reducing due to heat deterioration.

The resilient member 22 comes in contact with an outer wall 32*a* of a body part 32 of the female housing 5. The resilient member 22 is provided with a groove 22*a*, into which an end part of the outer wall 32*a* enters. Further, a surface of the resilient member 22 facing the outer wall 32*a* is formed in a tapered shape so as to facilitate the entering of the end part of the outer wall 32*a*. The end part of the outer wall 32*a* is formed tapered to a point so as to facilitate the entering thereof into the end part 10*a*.

When the male housing 2 and the female housing 5 fit to each other, the end part of the outer wall 32*a* of the body part 32 of the female housing 5 enters the end part 10*a* of the gap 10. The end part of the outer wall 32*a* enters the groove 22*a* of the resilient member 22 so as to resiliently deform the resilient member 22 and closely comes in contact with the resilient member 22 so as to be received in the groove 22*a*. The resilient member 22 absorbs the omnidirectional shaking of the outer wall 32*a*, that is, the omnidirectional shaking of the female housing 5.

According to the preferred embodiment described above, the male housing 2 includes the end part 10*a*, into which the end part of the outer wall 32*a* of the body part 32 of the female housing 5 enters. Therefore, the end part of the outer wall 32*a* enters the end part 10*a*, so that the female housing 5 and the male housing 2 are stably fixed to each other. Accordingly, the connector 1 can be prevented from being shaken with the simple structure thereof so that the connector 1 can be prevented from suffering from failure in electrical continuity due to abrasion of the terminal fitting.

The width of the end part 10*a* is formed to decrease as the end part 10*a* leaves the end part of the outer wall 32*a*. Therefore, the outer wall 32*a* stably comes in contact with the inner surface of the end part 10*a*, so that the female housing 5 and the male housing 2 are further stably fixed to each other. Accordingly, the connector 1 can be prevented from being shaken with the simple structure thereof so that the connector 1 can be prevented from suffering from failure in electrical continuity due to abrasion of the terminal fitting.

The inner surface of the end part 10*a* includes the resilient member 22. Therefore, the inner surface of the end part 10*a* closely comes in contact with the end part of the outer wall 32*a* through the resilient member 22, and the resilient member 22 is resiliently deformed so as to absorb the shaking of the male housing 2 and the female housing 5. Accordingly, the connector 1 can be prevented from being shaken with the simple structure thereof so that the connector can be prevented from suffering from failure in electrical continuity due to abrasion of the terminal fitting. Further, since the resilient member 22 is positioned so as to receive the end part of the outer wall 32*a*, therefore resilient member 22 effectively absorbs the omnidirectional shaking of the connector 1. Furthermore, by composing the resilient member 22 with heat resisting resilient material, the effect for preventing the shaking of the connector 1 can be prevented from reducing due to heat deterioration.

Further, in the second preferred embodiment described above, the resilient member 22 is provided on the inner surface of the end part 10*a*. However, instead, the resilient member 22 may be provided on the end part of the outer wall 32*a*. Further, the resilient member 22 may be provided on both the inner surface of the end part 10*a* and the end part of the outer wall 32*a*.

The aforementioned preferred embodiments are described to aid in understanding the present invention and variations may be made by one skilled in the art without departing from the spirit and scope of the present invention.

What is claimed is:

1. A connector comprising:

a first connector housing having a tube-shaped hood part;

a second connector housing to be fitted to the first connector housing; and an annular-shaped groove part provided outside a terminal receiving part of the second connector housing, wherein the terminal receiving part of the second connector housing is positioned in the hood part so that the first and second connector housings are fitted to each other, wherein an end part of the hood part abuts against a tapered portion of the groove part so that the end part of the hood part is received in the groove part when the first and second connector housings are fitted to each other, and wherein a width of the groove part decreases from a hood part-entering side of the groove part to the depth side of the groove part.

2. The connector according to claim 1, wherein at least one of an inner surface of the groove part and the end part of the hood part includes a resilient member made of resilient material.

3. The connector according to claim 1, wherein the first connector housing includes an engaging part, the second connector housing includes a mating engaging part to be engaged with the engaging part, and at least one of the engaging part and the mating engaging part includes a resilient member made of resilient material.

* * * * *